United States Patent [19]

Kipp et al.

[11] Patent Number: 4,654,155

[45] Date of Patent: Mar. 31, 1987

[54] MICROEMULSION LUBRICANT

[75] Inventors: Egbert M. Kipp, Devon, Pa.; Barry L. Riddle, Richmond, Va.

[73] Assignee: Reynolds Metals Company, Richmond, Va.

[21] Appl. No.: 827,149

[22] Filed: Feb. 7, 1986

Related U.S. Application Data

[63] Continuation-in-part of Ser. No. 717,816, Mar. 29, 1985, and a continuation-in-part of Ser. No. 536,709, Sep. 28, 1983, abandoned.

[51] Int. Cl.[4] ..... C10M 137/06; C10M 137/08

[52] U.S. Cl. ..... 252/32.5; 252/49.5

[58] Field of Search ..... 252/49.5, 32.5

[56] References Cited

U.S. PATENT DOCUMENTS

| | | | |
|---|---|---|---|
| 3,227,652 | 1/1966 | Ackerman | 252/49.5 |
| 3,310,489 | 3/1967 | Davis | 252/32.5 |
| 3,444,080 | 5/1969 | Berger | 252/49.5 |
| 3,558,489 | 1/1971 | Matson | 252/32.5 |
| 3,699,057 | 10/1972 | Halko, Sr. et al. | 252/49.3 |
| 3,718,588 | 2/1973 | Bellos et al. | 252/32.5 |
| 3,925,216 | 12/1975 | Moorhouse | 252/49.3 |
| 3,933,660 | 1/1976 | Tadenuma et al. | 252/32.5 |
| 3,945,930 | 3/1976 | Sugiyama et al. | 252/32.5 |
| 4,116,872 | 9/1978 | Jahnke | 252/32.5 X |
| 4,170,673 | 10/1979 | Conti | 427/401 |
| 4,171,337 | 10/1979 | Rosen et al. | 264/56 |
| 4,243,537 | 1/1981 | Knepp et al. | 252/49.3 |
| 4,371,447 | 2/1983 | Webb | 252/49.5 |
| 4,521,321 | 6/1985 | Anderson et al. | 252/32.5 X |

*Primary Examiner*—William R. Dixon, Jr.
*Assistant Examiner*—Ellen M. McAvoy
*Attorney, Agent, or Firm*—Alan T. McDonald

[57] ABSTRACT

An improved water-emulsifiable metal-working lubricant is disclosed which consists essentially of water, a complex organic phosphate ester, an amine, a polyoxyalkylated animal or vegetable oil product, one or more polyol and/or polyalkylene glycol esters and a polyalkylene glycol polymer.

15 Claims, No Drawings

MICROEMULSION LUBRICANT

CROSS-REFERENCE TO RELATED APPLICATIONS

This is a continuation-in-part of U.S. application Ser. No. 717,816, filed Mar. 29, 1985, and a continuation-in-part of U.S. application Ser. No. 536,709, filed Sept. 28, 1983, now abandoned.

FIELD OF THE INVENTION

The present invention relates to microemulsion metal-working lubricants and more specifically to oil-in-water microemulsion lubricants useful in working aluminum.

BACKGROUND OF THE INVENTION

The prior art is replete with lubricant formulations useful in the hot rolling of metals such as aluminum.

With the evolution of hot rolling equipment toward rolling mills that produce higher pressures at ever-increasing operating speeds, the demands placed on the lubricants used in such mills have increased with each new generation of rolling equipment. Such increasing demands have resulted in further expansion of the list of lubricant formulations useful in hot rolling operations.

To the best of our knowledge, however, all of the "new and improved" formulations possess certain inherent problems, some or all of which to date have not been solved by any one formulation. For example, Knepp U.S. Pat. No. 4,243,537 requires the use of fatty acids, which are known to be depleted during use through their conversion to metallic soaps, eventually resulting in unstable and inadequate lubrication, as well as interfering with general lubricant manageability. An object of the present invention, not realized by Knepp, is the elimination of fatty acids and their precursors. The use of complex organic phosphate esters in compositions with and without fatty acids and their precursors is known in Sugiyama U.S. Pat. No. 3,945,930. However, Sugiyama does not recognize that the use of certain polyalkylene glycol polymers will synergistically enhance the lubricating performance of complex organic phosphate esters, further eliminating the need for harmful fatty acids and their precursors. Exploitation of this synergistic behavior is a further object of the present invention. In the lubricant compositions of the prior art, there are problems related to: (1) physical stability, (2) high temperature capability, (3) chemical stability, (4) inability to withstand extreme pressure lubrication conditions over extended periods of use, (5) corrositivity, and (6) tolerance of reclamation processes.

Each of these characteristics is familiar to the skilled lubricant technician. Physical stability relates to the ability of the lubricant components to remain as initially formulated without separating into macroscopically observable multiple phases. Such separation is characteristic of macroemulsions and is one means for distinguishing between macroemulsion and microemulsion lubricant types. Microemulsions also are visually translucent or transparent in appearance as a result of the dispersed phase droplets being predominately less than 0.2 micrometers in diameter. High temperature capability defines the ability of the lubricant to tolerate the temperatures required for and produced in metal-working operations without one or more of the components evaporating or undergoing chemical degradation to such an extent that the composition of the lubricant bulk would be altered. Additionally, high temperature capability includes the ability of the lubricant to extract heat from the metalworking operation at a rate and in a manner which is beneficial to the manufacturing equipment and to the end product. Chemical stability describes the capacity of the lubricant to not undergo chemical changes, in storage or in use, which would adversely affect the metalworking operation. The ability to provide adequate extreme pressure lubrication defines the ability of the lubricant to reduce or prevent conditions of seizure or welding between the tool, e.g., the rolling mill, etc., and the workpiece under conditions of extreme load. Corrositivity relates to adverse chemical attack on the metal-working machinery and/or the workpiece. The ability to tolerate reclamation processes relates to the lubricant's capacity to undergo, without physical or chemical degradation and/or significant depletion of the lubricant's ingredients, those physical and/or chemical operations which are designed to remove fines, dirt, and other contaminants of the metal-working operation. These reclamation processes further include reconstitution of any constituents of the lubricant which have undergone depletion or dilution during use of the lubricant.

Thus, it has been the aim of the formulators of lubricants to design a formulation which eliminates or alleviates all of the foregoing problems.

SUMMARY OF THE INVENTION

There has now been discovered a readily water-microemulsifiable concentrate which, when dispersed in water, provides an oil-in-water microemulsion lubricant which eliminates substantially all of the foregoing problems with such lubricants and demonstrates satisfactory or substantially improved lubricant characteristics.

According to the present invention, there is provided an improved water-microemulsifiable metalworking lubricant concentrate in which the dispersed phase oil droplets, when emulsified, are predominately less than 0.2 micrometers in diameter and comprising:

(a) up to about fifty percent by volume water;

(b) an amount of a complex organic phosphate ester sufficient to provide in the metal-working lubricant a concentration of from about 0.3 to about 1.0 percent by volume, the complex organic phosphate ester having the formula

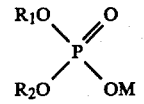

wherein

M is selected from the group consisting of hydrogen, metal cations, an amine selected from the group consisting of alkylamine cations, including ethyl amine, diethyl amine, octyl amine, and octadecyl amine, an amine selected from the group consisting of alkanolamine cations, including monoethanolamine, diethanolamine, triethanolamine, and aminomethyl propanol, and an amine selected from the group consisting of heterocyclic amines, including morpholine and its analogs;

$R_1$ is a polyoxyalkylated alcohol wherein the alcohol portion is derived from a member of the group consisting of saturated and unsaturated alkyl radicals having one to about twenty carbon atoms, aryl radicals, and alkylaryl radicals wherein the alkyl substituent comprises from one to about twenty carbon atoms and is saturated or unsaturated, and wherein the polyoxyalkylated portion of $R_1$ is derived from ethylene oxide, propylene oxide, butylene oxide, or other polymerizable alkylene oxide, a polyhydric alkanol having from about two to about ten carbon atoms, or a combination of these, wherein the number of monomeric units of any single type is from one to about fifty; and wherein $R_2$ is defined as is $R_1$ or as is M above, but it need not be exactly identical to either so long as it can be described as one or the other;

(c) an amount up to about twenty percent by volume of an amine selected from the group consisting of alkylamine cations, including ethyl amine, diethyl amine, octyl amine, and octadecyl amine, an amine selected from the group consisting of alkanolamine cations, including monoethanolamine, diethanolamine, triethanolamine, and aminomethyl propanol, and an amine selected from the group consisting of heterocyclic amines, including morpholine and its analogs;

(d) from about five to about forty percent by volume of a polyoxyalkylated animal or vegetable oil product in which the polyoxyalkylated portion is derived from ethylene oxide, propylene oxide, butylene oxide, or other polymerizable alkylene oxide, a polyhydric alkanol having from about two to about ten carbon atoms, or a combination of these, wherein the number of monomeric units of any single type is from one to about fifty;

(e) up to about twenty percent by volume of one or more polyol and/or polyalkylene glycol esters wherein the esterified carboxylic acid or acids are saturated or unsaturated, aliphatic or cyclic, and comprise from one to about forty carbon atoms, and wherein the polyalkylene glycol portion of the molecule, when present, has a molecular weight from about 200 to about 2000; and (f) from about five to about sixty percent by volume of a polyalkylene glycol homopolymer, block or random heteropolymer, or functionally grafted homopolymer or block or random heteropolymer, or mixture of said polymers, having the formula

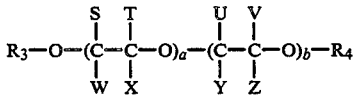

wherein $R_3$ and $R_4$ need not be exactly identical to each other, but are each selected from the group consisting of hydrogen, hydrocarbons having from one to about six carbon atoms, alcohols having from one to about six carbon atoms, amines having from one to about six carbon atoms, and mercaptans having from one to about six carbon atoms;

wherein S,T,U,V,W,X,Y, and Z need not be exactly identical to each other, but are each selected from the group consisting of hydrogen, hydrocarbon radicals having from one to about four carbon atoms, hydroxyl, carboxyl, orthophosphate, and sulfate moieties; and wherein the sum of a and b ranges from 2 to about 450, such that the average molecular weight of the polyalkylene glycol polymer ranges from about 200 to about 20,000.

DETAILED DESCRIPTION OF THE PREFERRED EMBODIMENTS

The ingredients of metal-working lubricants can be generally classified according to their primary functions. Such a classification scheme is valuable as an organizational tool, but it must be understood that most lubricant ingredients fulfill multiple functions. When properly chosen, the ingredients of a lubricant formulation may act synergistically, that is, one or more components may enhance the effectiveness of one or more of the other components.

This functional or operational classification divides lubricants into three basic categories. These categories are: (1) the vehicle, (2) emulsifier(s), and (3) lubricant additives. The final category is further subdivided into additives which provide or enhance (a) "oiliness", and (b) extreme pressure capability (E.P. hereafter).

In the present lubricant composition, water may be present in the lubricant concentrate to promote mutual solubility of the "active" ingredients and to reduce the concentrate viscosity. Most generally, water concentrations, in the concentrate, of between about twenty-five and about fifty volume percent are satisfactory for most applications. However, in some certain embodiments of the present invention, those physical characteristics of the concentrate which make transportation and storage more convenient may be achieved without the presence of water.

The vehicle of the present lubricant is preferably a polyalkylene glycol polymer. The molecular structure, molecular weight, polarity, cloud point and terminal group functionality are selected so that, in use, this vehicle thermally separates from the microemulsion when flooded onto the metal workpiece. A hydrodynamic (full fluid) film is formed on the work surface. The film thus formed provides load support and assists the water phase in carrying the other active ingredients into the work zone; the roll bite, in the case of hot rolling. It is known in the art that the rate of thermal separation should be maximized to reduce "push-up" without causing refusals or skidding in the work area. Furthermore, when the polyalkylene glycol polymer ingredient is properly selected, it acts to reinforce the boundary lubricating properties of the complex organic phosphate ester ingredient. Incorrect selection of this polymer ingredient's molecular features and physical properties for the metal-working operation of interest will result in catastrophic failure of the lubricant through excessive workpiece-tool slippage and scuffing of the workpiece, seizure between the workpiece and the tool, galling, residue formation, corrosion, etc. In the formulation of the present invention, the rate of thermal separation is controlled by judicious selection of the polyalkylene glycol material and the other ingredients which are described below.

A wide variety of compatible polyalkylene glycol materials are useful as the vehicle in the formulations of the present invention. Chemically, these materials may be described as being a polyalkylene glycol homopolymer, block or random heteropolymer, or functionally grafted homopolymer or block or random heteropolymer, or mixture of said polymers, having the formula

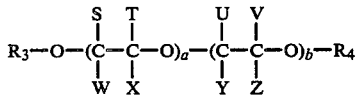

wherein $R_3$ and $R_4$ need not be exactly identical to each other, but are each selected from the group consisting of hydrogen, hydrocarbons having from one to about six carbon atoms, alcohols having from one to about six carbon atoms, amines having from one to about six carbon atoms, and mercaptans having from one to about six carbon atoms;

wherein S,T,U,V,W,X,Y, and Z need not be exactly identical to each other, but are each selected from the group consisting of hydrogen, hydrocarbon radicals having from one to about four carbon atoms, hydroxyl, carboxyl, orthophosphate, and sulfate moieties; and wherein the sum of a and b ranges from 2 to about 450, such that the average molecular weight of the polyalkylene glycol polymer ranges from about 200 to about 20,000.

Useful such materials are available under the tradenames "Carbowax", "Ucon", and "Polyox", from Union Carbide Corporation of Danbury, Conn. and "Pluronic", "Tetronic", "Quadrol", "Pluradot", "Pluracol", and "Pluraflo", from BASF Wyandotte of Parsippany, N.J. The concentration of the vehicle in the concentrate and in the final lubricant may, of course, vary widely depending upon such factors as the metal being worked, the speed of the working operation, the type of working operation, choice of additional ingredients, etc. For most applications, polyalkylene glycol polymer molecular weights in the range of about 200 to about 20,000 are preferred. Most generally, vehicle concentrations, in the concentrate, of between about five and about sixty volume percent are satisfactory for most applications, particularly in the hot rolling of aluminum.

Oiliness lubricating additives are normally natural products such as fatty acids, glycerides, and their derivatives. Such materials become concentrated during rolling operations in the roll bite because of the attraction between the metal surface(s) and the polar functional groups of these molecules. In the work zone, these additives function by providing a cushion between surfaces and by acting as viscosity modifiers of the vehicle. Various fatty acids, such as oleic acid and natural sources of oleic acid, such as tall oil and lard oil, have been used as such additives in the aluminum industry. Although such fatty acids have seen broad application in this field, their effectiveness as "oiliness" additives has been diminished because of their tendency to form rapidly depleting, insoluble metallic soaps which blind the filtration systems conventionally used to purify lubricants/coolants in operating systems. The loss of these ingredients through their conversion to insoluable soaps also adversely affects the lubricating properties of the lubricant formulation, resulting in shorter tool life and surface damage to the workpiece. Oleic acid, other fatty acids and their precursors are, therefore, to be specifically excluded from the lubricant compositions of the present invention.

Polyoxyalkylated animal or vegetable oils and polyol and/or polyalkylene glycol esters function as "oiliness" additives. Such ingredients effectively provide the semiboundary lubricating properties of fatty acids and fatty acid soaps, without the forementioned disadvantages of such materials, when used in conjunction with the other ingredients of the present invention. This substitution provides extended filter life, since the substituted materials do not generate insoluble metallic soaps or any other product with a tendency to impede reclamation processes, such as conventional filters.

Additionally, the polyoxyalkylated vegetable oils described hereinabove serve not only as "oiliness" lubricating additives, but also as emulsifiers. In the preferred lubricant of the present invention, microemulsion droplet size distribution, and hence microemulsion stability, are controlled by this ingredient of the formulation. Further, this polyoxyalkylated natural oil ingredient influences the thermal separation of the lubricating additives from the microemulsion onto the metal surface. In the preferred lubricant of the present invention, microemulsion droplet stability and, to some extent, thermal separation, are controlled by the emulsifier(s) included in the lubricant. The properties of these multifunctional additives depend on the selection of the base animal or vegetable oil and the specific manner and extent to which it is polyoxyalkylated. The choice of these factors may vary considerably depending upon the specific metal-working operation to be performed.

According to a preferred embodiment of the present invention, the polyoxyalkylated animal or vegetable oil products are selected from polyoxyethylated castor oil, peanut oil, coconut oil, soya oil, safflower oil, cottonseed oil, tallow, lard and the like. Concentrations of this material, in the concentrate, of between about five and forty volume percent are satisfactory for most applications. Useful such materials are available from Emery Industries, Inc. of Mauldin, S.C., under the tradenames "Trylox" and "Trydet", from ICI Americas, Inc. of Wilmington, Del. under the tradename "Atlox", from GAF Corporation of New York, N.Y. under the tradename "Emulphor", and from Alkaril Chemicals, Ltd, of Yorkshire, England under the tradename "Alkasurf".

Among the polyol and/or polyalkylene glycol esters useful in the present invention are those in which the esterified carboxylic acid or acids may be saturated or unsaturated, aliphatic or cyclic, and comprise from one to about forty carbon atoms. Useful materials in this class comprise the fatty acid esters of sorbitol, sorbitan, their derivatives, and similar such compounds. Specifically preferred within this class of compounds are polyethylene glycol fatty acid esters such as those offered under the following tradenames from these companies: "Kessco PEG" from Stepan Chemical Company of Maywood, N.J., "Tridet" and "Emerest" from Emery Industries, Inc. of Mauldin, S.C., "Myrj" and "Renex" of ICI Americas, Inc. of Wilmington, Del., and "Mapeg" from Mazer Chemicals, Inc. of Gurnee, Ill. According to a preferred embodiment of the present invention, the polyol and/or polyalkylene glycol esters have average molecular weights for the polyalkylene glycol portion of the molecule, when present, of about 200 to about 2000 and comprise up to about twenty percent by volume of the lubricant concentrate.

The final component of the lubricant compositions of the present invention is the "extreme pressure" or E.P. additive. Such additives, as indicated above, concentrate in the roll bite or other area of metal-working, much like the oiliness additives do, but are generally thought to react with the metal or metal oxide rubbing surfaces to form a solid film of lubricant.

Useful organic phosphate esters are those having the formula:

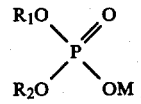

wherein M is selected from the group consisting of hydrogen, metal cations, an amine selected from the group consisting of alkylamine cations, including ethyl amine, diethyl amine, octyl amine, and octadecyl amine, an amine selected from the group consisting of alkanolamine cations, including monoethanolamine, diethanolamine, triethanolamine, and aminomethyl propanol, and an amine selected from the group consisting of heterocyclic amines, including morpholine and its analogs;

wherein $R_1$ is a polyoxyalkylated alcohol where the alcohol portion is derived from the group consisting of saturated and unsaturated alkyl radicals having one to about twenty carbon atoms, aryl radicals, and alkylaryl radicals wherein the alkyl substituent comprises from one to about twenty carbon atoms and may be saturated or unsaturated, and wherein the polyoxyalkylated portion of $R_1$ may be derived from ethylene oxide, propylene oxide, butylene oxide, or a similar polymerizable alkylene oxide, a polyhydric alkanol having from about two to about ten carbon atoms, or a combination of these, wherein the number of monomeric units of any single type may be from about one to about fifty; and wherein $R_2$ is defined as is $R_1$ or as is M above, but it need not be exactly identical to either so long as it can be described as one or the other.

The concentration of the complex organic phosphate ester in the lubricant concentrate of the present invention is that concentration required to provide, in the working lubricant, a concentration from about 0.3 to about 1.0 volume percent of the complex organic phosphate ester. The complex phosphate ester E.P. additive is neutralized with sufficient triethanolamine or other such commonly used alkanolamines, alkylamines, or heterocyclic amines so as to provide a pH of about 7.0 to about 9.0 in the metal-working fluid. The amine is present in an amount up to about twenty percent by volume. According to a preferred embodiment of the present invention, the volume ratio of complex phosphate ester to amine should be about 2:1.

In addition to providing a suitable pH for the lubricant, the amine enhances the boundary lubricating properties of the complex phosphate ester, reduces the corrosion of ferrous machine parts, and enhances the performance of many commonly used bacteriocides.

Complex organic phosphate esters of the type described hereinabove are readily available under the following tradenames from these companies: "Maphos" from Mazer Chemicals, Inc. of Gurnee, Ill., "Cyclophos" from Cyclo Chemicals Corporation of Miami, Fla., "Gafac" and "Antara" from GAF Corporation of New York, N.Y., and "Vanlube" from R. T. Vanderbilt Company, Inc. of Norwalk, Conn.

In a preferred composition of the present invention, the polyalkylene glycol polymer and the phosphate ester E.P. additive are selected so as to achieve extreme pressure lubricating effects superior to those expected from the presence of either single component. Further, when these ingredients are properly chosen, such synergistic effects permit the use of lower concentrations of the phosphate ester ingredient and/or lower concentrations of the in-use metal-working fluid than would otherwise be necessary for adequate lubricant performance.

The cooperative interaction of these key ingredients is demonstrated by the example below. Table 1 defines four lubricant variations. These variations (I–IV) include possible combinations of components "b" and "f," the complex organic phosphate ester and the polyalkylene glycol polymer, respectively. Formula I employs neither of the critical constituents. Formulae II and III employ these materials singly. Formula IV employs them in combination with each other.

TABLE I

| Component/Material | Formula (parts by volume) I | II | III | IV |
|---|---|---|---|---|
| a. Deionized water | 950.0 | 950.0 | 950.0 | 950.0 |
| b. GAF Corporation Gafac RK-500 (Complex Organic Phosphate Ester) | 0.0 | 0.0 | 6.0 | 3.0 |
| c. Triethanolamine (Alkanolamine) | 4.5 | 2.2 | 4.0 | 2.0 |
| d. GAF Corporation Emulphor E1-620 (Polyoxyalkylated Vegetable Oil) | 34.1 | 16.0 | 30.0 | 15.0 |
| e. Stepan Chemical PEG 600 Monooleate (Polyalkylene Glycol Ester) | 11.4 | 5.3 | 10.0 | 5.0 |
| f. Union Carbide Corporation Ucon MLX-1281 (Polyalkylene Glycol Polymer) | 0.0 | 26.5 | 0.0 | 25.0 |

Without further dilution, these four lubricant variations were evaluated under the conditions described in ASTM D 2783-71, the "Standard Method for Measurement of Extreme-Pressure Properties of Lubricating Fluids by the Four Ball Method." In this test, loads are increased in a stepwise fashion until the lubricant film fails to prevent seizure between a rotating steel ball and three stationary steel balls. The load at which such lubricant failure occurs is defined to be the "weld point" of the lubricant. In this test, lubricants having superior extreme pressure lubricating properties exhibit the highest weld points.

Table 2 lists weld point results for the lubricant variations of Table 1. Extreme pressure lubricating performance of formulae with either the polyalkylene glycol polymere or the complex organic phosphate ester components alone (formulae II and III, respectively) is superior to that of composition I, where neither material was present. When both critical components are present (formula IV), the weld point is superior to all previous compositions. If the beneficial effect on extreme pressure lubricating properties of the complex organic phosphate ester and the polyalkylene glycol polymer were only additive in nature, their combination (formula IV) would be expected to yield a weld point of 240 kg. The 290 kg weld point which was observed is indicative of the cooperative effect of using complex organic phosphate esters and polyalkylene glycols in combination.

TABLE 2

| Formula | Weld Point (kg) | Improvement Over Control (kg) |
|---|---|---|
| I (control) | 90 | — |
| II | 130 | +40 |
| III | 200 | +110 |
| IV | 290 | +200 |

While the lubricant compositions of the present invention have been described with reference to certain specific embodiments thereof, it is not intended to be so limited thereby, except as set forth in the accompanying claims.

We claim:

1. An improved water-microemulsifiable metal-working lubricant concentrate in which the dispersed phase oil droplets, when emulsified, are predominately less than 0.2 micrometers in diameter and consisting essentially of:

(a) up to about fifty percent by volume water;

(b) an amount of a complex organic phosphate ester sufficient to provide in the metal-working lubricant a concentration of from about 0.3 to about 1.0 percent by volume, the complex organic phosphate ester having the formula

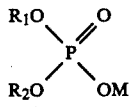

wherein

M is selected from the group consisting of hydrogen, metal cations, an amine selected from the group consisting of alkylamine cations, including ethyl amine, diethyl amine, octyl amine, and octadecyl amine, an amine selected from the group consisting of alkanolamine cations, including monoethanolamine, diethanolamine, triethanolamine, and aminomethyl propanol, and an amine selected from the group consisting of heterocyclic amines, including morpholine and its analogs;

$R_1$ is a polyoxyalkylated alcohol wherein the alcohol portion is derived from a member of the group consisting of saturated and unsaturated alkyl radicals having one to about twenty carbon atoms, aryl radicals, and alkylaryl radicals wherein the alkyl substituent comprises from one to about twenty carbon atoms and is saturated or unsaturated, and wherein the polyoxyalkylated portion of $R_1$ is derived from ethylene oxide, propylene oxide, butylene oxide, other polymerizable alkylene oxide, a polyhydric alkanol having from about two to about ten carbon atoms, or a combination of these, wherein the number of monomeric units of any single type is from one to about fifty; and wherein $R_2$ is defined as is $R_1$ or as is M above, but it need not be exactly identical to either, so long as it can be described as one or the other;

(c) an amount up to about twenty percent by volume of an amine selected from the group consisting of alkylamine cations, including ethyl amine, diethyl amine, octyl amine, and octadecyl amine, an amine selected from the group consisting of alkanolamine cations, including monoethanolamine, diethanolamine, triethanolamine, and aminomethyl propanol, and an amine selected from the group consisting of heterocyclic amines, including morpholine and its analogs;

(d) from about five to about forty percent by volume of a polyoxyalkylated animal or vegetable oil product in which the polyoxyalkylated portion is derived from ethylene oxide, propylene oxide, butylene oxide, or other polymerizable alkylene oxide, a polyhydric alkanol having from about two to about ten carbon atoms, or a combination of these, and wherein the number of monomeric units of any single type is from one to about fifty;

(e) up to about twenty percent by volume of one or more polyol and/or polyalkylene glycol esters wherein the esterified carboxylic acid or acids are saturated or unsaturated, aliphatic or cyclic, and comprise from one to about forty carbon atoms, and wherein the polyalkylene glycol portion of the molecule, when present, has a molecular weight from about 200 to about 2000; and (f) from about five to about sixty percent by volume of a polyalkylene glycol homopolymer, block or random heteropolymer, or functionally grafted homopolymer or block or random heteropolymer, or mixture of said polymers, having the formula

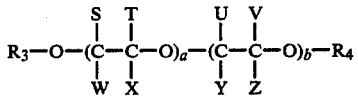

wherein $R_3$ and $R_4$ need not be exactly identical to each other, but are each selected from the group consisting of hydrogen, hydrocarbons having, from one to about six carbon atoms, alcohols having from one to about six carbon atoms, amines having from one to about six carbon atoms, and mercaptans having from one to about six carbon atoms;

wherein S,T,U,V,W,X,Y, and Z need not be exactly identical to each other, but are each selected from the group consisting of hydrogen, hydrocarbon radicals having from one to about four carbon atoms, hydroxyl, carboxyl, orthophosphate, and sulfate moieties; and wherein the sum of a and b ranges from 2 to about 450, such that the average molecular weight of the polyalkylene glycol polymer ranges from about 200 to about 20,000; said concentrate being substantially free from fatty acids and their precursors.

2. The concentrate of claim 1 wherein M is the cation of triethanolamine, $R_1$ is a polyoxyethylated alcohol of which the hydrophobic portion is saturated, aliphatic, and contains from about eight to about fourteen carbon atoms; of which the hydrophilic portion is derived from a polymerization of ethylene oxide such that the mole ratio of ethylene oxide with respect to the complex organic phosphate ester molecule is about 3 to about 7; $R_2$ is the cation of triethanolamine; and the concentration of the complex organic phosphate ester in the concentrate is sufficient to provide in the metal-working lubricant a concentration of the complex organic phosphate ester of between 0.5 and 1.0 volume percent.

3. The concentrate of claim 1 wherein the concentration of triethanolamine in the concentrate is sufficient to impart to the metal-working lubricant a pH between about 7.0 and 9.0, and the triethanolamine is greater than about 80% purity.

4. The concentrate of claim 1 wherein the amine of parts (b) and (c) is morpholine.

5. The concentrate of claim 1 wherein the amine of parts (b) and (c) is a mixture of alkanolamines, including monoethanolamine, diethanolamine, triethanolamine, or aminomethyl propanol, with morpholine.

6. The concentrate of claim 1 wherein the polyoxyalkylated animal or vegetable oil product is polyoxyethylated vegetable oil, substantially free of fatty acids.

7. The concentrate of claim 1 wherein the ester of part (e) is a polyethylene glycol monooleate, substantially free of fatty acids.

8. The concentrate of claim 1 wherein the ester of part (e) is a polyethylene glycol dioleate, substantially free of fatty acids.

9. The concentrate of claim 1 wherein the polyalkylene glycol of part (f) is a homopolymer of ethylene oxide.

10. The concentrate of claim 1 wherein the polyalkylene glycol of part (f) is a homopolymer of propylene oxide.

11. The concentrate of claim 1 wherein the polyalkylene glycol of part (f) is a homopolymer of butylene oxide.

12. The concentrate of claim 1 wherein the polyalkylene glycol of part (f) is a copolymer of ethylene oxide and propylene oxide, or ethylene oxide and butylene oxide, or propylene oxide and butylene oxide, or a mixture of said copolymers.

13. The concentrate of claim 1 wherein the polyalkylene glycol of part (f) is a functionally grafted homopolymer.

14. The concentrate of claim 1 wherein the polyalkylene glycol of part (f) is a functionally grafted heteropolymer.

15. An oil-in-water metal-working microemulsion lubricant in which the dispersed phase oil droplets are predominately less than 0.2 micrometers in diameter and consisting essentially of:

(I) from about 80 to about 99 percent by volume water; and (II) from about 1 to about 20 percent by volume of a water-microemulsifiable metal-working lubricant concentrate consisting essentially of:

(a) up to about fifty percent by volume water;

(b) an amount of a complex organic phosphate ester sufficient to provide in the metal-working lubricant a concentration of from about 0.3 to about 1.0 percent by volume, the complex organic phosphate ester having the formula

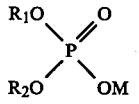

wherein M is selected from the group consisting of hydrogen, metal cations, an amine selected from the group consisting of alkylamine cations, including ethyl amine, diethyl amine, octyl amine, and octadecyl amine, an amine selected from the group consisting of alkanolamine cations, including monoethanolamine, diethanolamine, triethanolamine, and aminomethyl propanol, and an amine selected from the group consisting of heterocyclic amines, including morpholine and its analogs;

wherein $R_1$ is a polyoxyalkylated alcohol wherein the alcohol portion is derived from a member of the group consisting of saturated and unsaturated alkyl radicals having one to about twenty carbon atoms, aryl radicals, and alkylaryl radicals wherein the alkyl substituent comprises from one to about twenty carbon atoms and is saturated or unsaturated, and wherein the polyoxyalkylated portion of $R_1$ is derived from ethylene oxide, propylene oxide, butylene oxide, or other polymerizable alkylene oxide, a polyhydric alkanol having from about two to about ten carbon atoms, or a combination of these, wherein the number of monomeric units of any single type is from one to about fifty; and wherein $R_2$ is defined as is $R_1$ or as is M above, but it need not be exactly identical to either, so long as it can be described as one or the other;

(c) an amount up to about twenty percent by volume of an amine selected from the group consisting of alkylamine cations, including ethyl amine, diethyl amine, octyl amine, and octadecyl amine, an amine selected from the group consisting of alkanolamine cations, including monoethanolamine, diethanolamine, triethanolamine, and aminomethyl propanol, and an amine selected from the group consisting of heterocyclic amines, including morpholine and its analogs;

(d) from about five to about forty percent by volume of a polyoxyalkylated animal or vegetable oil product in which the polyoxyalkylated portion is derived from ethylene oxide, propylene oxide, butylene oxide, or other polymerizable alkylene oxide, a polyhydric alkanol having from about two to about ten carbon atoms, or a combination of these, and wherein the number of monomeric units of any single type is from one to about fifty;

(e) up to about twenty percent of one or more polyol and/or polyalkylene glycol esters wherein the esterified carboxylic acid or acids are saturated or unsaturated, aliphatic or cyclic, and comprise from one to about forty carbon atoms, and wherein the polyalkylene glycol portion of the molecule, when present, has a molecular weight from about 200 to 2000; and (f) from about five to about sixty percent by volume of a polyalkylene glycol homopolymer, block or random heteropolymer, or functionally grafted homopolymer or block or random heteropolymer, or mixture of said polymers, having the formula

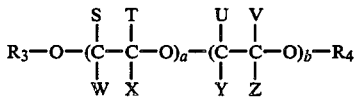

wherein $R_3$ and $R_4$ need not be exactly identical to each other, but are each selected from the group consisting of hydrogen, hydrocarbons having from one to about six carbon atoms, alcohols having from one to about six carbon atoms, amines having from one to about six carbon atoms, and mercaptans having from one to about six carbon atoms;

wherein S,T,U,V,W,X,Y, and Z need not be exactly identical to each other, but are each selected from the group consisting of hydrogen, hydrocarbon radicals having from one to about four carbon atoms, hydroxyl, carboxyl, orthophosphate, and sulfate moieties; and wherein the sum of a and b ranges from 2 to about 450, such that the average molecular weight of the polyalkylene glycol polymer ranges from about 200 to about 20,000; said concentrate being substantially free from fatty acids and their precursors.

* * * * *